US008944074B2

(12) United States Patent
Bullins et al.

(10) Patent No.: US 8,944,074 B2
(45) Date of Patent: Feb. 3, 2015

(54) REFINING APPARATUS

(75) Inventors: Terry L. Bullins, Walnut Cove, NC (US); Mark A. Vernon, Winston Salem, NC (US); Thomas Allen Costner, Pilot Mountain, NC (US); Timothy F. Tilley, Pinnacle, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 913 days.

(21) Appl. No.: 12/774,273

(22) Filed: May 5, 2010

(65) Prior Publication Data

US 2011/0271969 A1 Nov. 10, 2011

(51) Int. Cl.

| | |
|---|---|
| ***B02C 7/02*** | (2006.01) |
| ***A24B 5/16*** | (2006.01) |
| ***B02C 7/00*** | (2006.01) |
| ***A24B 5/10*** | (2006.01) |

(52) U.S. Cl.

CPC ... *A24B 5/16* (2013.01); *B02C 7/02* (2013.01); *B02C 7/00* (2013.01); *A24B 5/10* (2013.01)

USPC ..... 131/311

(58) Field of Classification Search

None

See application file for complete search history.

(56) References Cited

U.S. PATENT DOCUMENTS

| | | | | |
|---|---|---|---|---|
| 3,204,641 | A | | 9/1965 | O'Brien |
| 3,411,514 | A | | 11/1968 | Hind et al. |
| 3,556,112 | A | | 1/1971 | dela Burde |
| 3,690,328 | A | | 9/1972 | Quarenghi |
| 3,765,613 | A | | 10/1973 | Steiniger |
| 3,847,164 | A | | 11/1974 | Mattina et al. |
| 4,059,237 | A | | 11/1977 | Mannstrom |
| 4,131,117 | A | | 12/1978 | Kite et al. |
| 4,167,191 | A | | 9/1979 | Jewell et al. |
| 4,182,349 | A | | 1/1980 | Selke |
| 4,195,646 | A | | 4/1980 | Kite |
| 4,300,579 | A | | 11/1981 | Ulrich |
| 4,308,877 | A | | 1/1982 | Mattina |
| 4,341,228 | A | | 7/1982 | Keritsis et al. |
| 4,386,617 | A | | 6/1983 | Brackmann et al. |
| 4,421,126 | A | | 12/1983 | Gellatly |
| 4,706,692 | A | | 11/1987 | Gellatly |
| 4,783,014 | A | * | 11/1988 | Fredriksson et al. ..... 241/261.2 |
| 4,941,484 | A | | 7/1990 | Clapp et al. |
| 4,962,774 | A | | 10/1990 | Thomasson et al. |
| 4,987,906 | A | | 1/1991 | Young et al. |
| 5,056,537 | A | | 10/1991 | Brown et al. |
| 5,143,097 | A | | 9/1992 | Sohn et al. |
| 5,167,373 | A | | 12/1992 | Bohn et al. |
| 5,322,076 | A | | 6/1994 | Brinkley et al. |

(Continued)

*Primary Examiner* — Michael J Felton

(74) *Attorney, Agent, or Firm* — Womble Carlyle Sandridge & Rice, LLP

(57) ABSTRACT

An apparatus is provided for refining materials such as a tobacco material. The apparatus includes a disc assembly rotatably coupled to a drive arrangement. The disc assembly includes a disc body having first and second lateral surfaces each having a refining arrangement disposed thereon. First and second stationary refining arrangements are positioned in opposing relationship to the first and second lateral surfaces so as to form first and second refining zones. The disc assembly further includes first and second gear members. The first gear member is engaged with the drive arrangement, and the second gear member is engaged with the disc body. The first and second gear members are arranged to engage each other such that interaction therebetween rotatingly drives the disc body. The first and second gear members are configured to resist wear associated with interaction therebetween.

10 Claims, 9 Drawing Sheets

(56) References Cited

U.S. PATENT DOCUMENTS

| | | | |
|---|---|---|---|
| 5,325,877 | A | 7/1994 | Young et al. |
| 5,377,698 | A | 1/1995 | Litzinger et al. |
| 5,445,169 | A | 8/1995 | Brinkley et al. |
| 5,501,237 | A | 3/1996 | Young et al. |
| 5,533,530 | A | 7/1996 | Young et al. |
| 5,707,016 | A | 1/1998 | Witsken |
| 5,762,275 | A | 6/1998 | Aikawa |
| 6,053,440 | A * | 4/2000 | LaRiviere ..... 241/46.01 |

* cited by examiner

REFINING APPARATUS

BACKGROUND OF THE INVENTION

1. Field of the Invention

The present invention relates to products made or derived from tobacco, or that otherwise incorporate tobacco, and are intended for human consumption. In particular, embodiments of the present invention relate to apparatuses for refining tobacco material used in a smoking article, such as a cigarette.

2. Description of Related Art

Smoking articles, such as cigarettes, typically have a substantially cylindrical structure and include a charge, roll or column of smokable material such as shredded tobacco surrounded by a paper wrapper, thereby forming a tobacco rod.

The roll or column of tobacco used to fill the tobacco rod used in the manufacture of cigarettes may be cut from reconstituted tobacco sheet (such as, for example, R.J. Reynolds Tobacco Company so-called G-7 reconstituted tobacco sheet). Representative methods for making certain types of reconstituted tobacco sheet using papermaking-type processes are set forth, for example, in U.S. Pat. No. 3,847,164 to Mattina; U.S. Pat. No. 4,131,117 to Kite et al.; U.S. Pat. No. 4,182,349 to Selke; U.S. Pat. No. 4,308,877 to Mattina; U.S. Pat. No. 4,341,228 to Keritsis; U.S. Pat. No. 4,421,126 to Gellatly; U.S. Pat. No. 4,706,692 to Gellatly; U.S. Pat. No. 4,941,484 to Clapp et al.; U.S. Pat. No. 4,962,774 to Thomasson et al.; U.S. Pat. No. 4,987,906 to Young et al.; U.S. Pat. No. 5,056,537 to Brown et al.; U.S. Pat. No. 5,143,097 to Sohn et al.; U.S. Pat. No. 5,322,076 to Brinkley et al.; U.S. Pat. No. 5,325,877 to Young et al.; U.S. Pat. No. 5,377,698 to Litzinger; U.S. Pat. No. 5,445,169 to Brinkley et al.; U.S. Pat. No. 5,501,237 to Young et al.; and U.S. Pat. No. 5,533,530 to Young et al.; which are incorporated herein by reference.

In the manufacture of cigarettes, tobacco leaf is processed to separate the stems from the lamina. The lamina are shredded and formed into cigarettes or other smoking articles. The stems are not successfully utilizable as such in cigarette making because of their relatively large diameter, their hard nature and poor burning properties. Nevertheless, tobacco stem material constitutes a substantial proportion of the leaf, usually about 20 to 25% of the weight thereof, and contains other materials common to the lamina. In the past, therefore, efforts have been made to process the stem material for use in smoking articles. In this regard, specifically designed machinery has been employed for the treatment and/or processing of tobacco leaf stem material so as to form a tobacco pulp material, which can be formed into a sheet material and cut to an appropriate length. In one representative process, the tobacco sheet, once formed from the tobacco pulp material, is then dried to about 12% moisture and has a temperature slightly greater than ambient before being directed to a downstream slitter device for slitting the sheet into ribbons of various widths such as, for example, on the order of about 1-3 inches wide. Typically, the tobacco leaf stem material may be refined into the tobacco pulp material using a refiner, such as a Series 4000 double disc refiner available from Beloit Corporation (Metso Paper, Inc.). Types of equipment and methodologies suitable for the processing of tobacco leaf stem material also are set forth, for example, in U.S. Pat. No. 3,204,641 to Jones; U.S. Pat. No. 3,411,514 to Hind et al.; U.S. Pat. No. 3,556,112 to dela Burde et al.; U.S. Pat. No. 3,690,328 to Quarenghi; U.S. Pat. No. 4,167,191 to Jewell et al.; U.S. Pat. No. 4,195,646 to Kite; U.S. Pat. No. 4,300,579 to Ulrich; and U.S. Pat. No. 4,386,617 to Brackmann et al.; which are incorporated herein by reference.

Generally, double disc refiners implement a pair of rotatable discs with disc blades or other refining arrangements disposed thereon. The rotatable discs rotate against respective stationary blade arrangements or other refining arrangements, for grinding or otherwise refining the tobacco material supplied therebetween. The rotatable discs are coupled to a drive shaft driven by a drive motor. The rotational forces (torque) associated with the coupling to the drive shaft, and friction associated with the refining process and material processed thereby, for example, may cause portions of the rotatable discs and/or the disc blades to wear. Such wear issues typically lead to downtime associated with the refiner machine to allow for repairs, which can be costly and time consuming. Furthermore, the cost to replace the rotatable discs, stationary refining arrangements, and other components associated therewith, after such components succumbing to wear issues, can be substantial.

As such, it would be desirable to provide refining machinery capable of better withstanding various wear issues associated with the refining process performed thereby, so as to reduce instances of downtime for repairing such machinery, and also reducing costs associated with replacing components thereof.

BRIEF SUMMARY OF THE INVENTION

The above and other needs are met by the present invention which, according to one aspect, provides an apparatus for refining a material. The apparatus comprises a drive arrangement, and first and second stationary refining arrangements. The apparatus further comprises a disc assembly engaged with the drive arrangement and configured to be rotatably driven thereby. The disc assembly includes a disc body having first and second lateral surfaces facing away from each other. Each lateral surface has a refining arrangement disposed thereon for interacting with a material to be refined. The first and second stationary refining arrangements are positioned such that one of the first and second lateral surfaces opposes one of the first and second stationary refining arrangements to form a first refining zone and the other of the first and second lateral surfaces opposes the other of the first and second stationary refining arrangements to form a second refining zone. The disc assembly further includes first and second gear members. The first gear member is engaged with the drive arrangement, and the second gear member is engaged with the disc body. The first and second gear members are arranged to engage each other such that interaction therebetween rotatingly drives the disc body. The first and second gear members are configured to resist wear associated with interaction therebetween.

Embodiments of the present invention thus provide advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
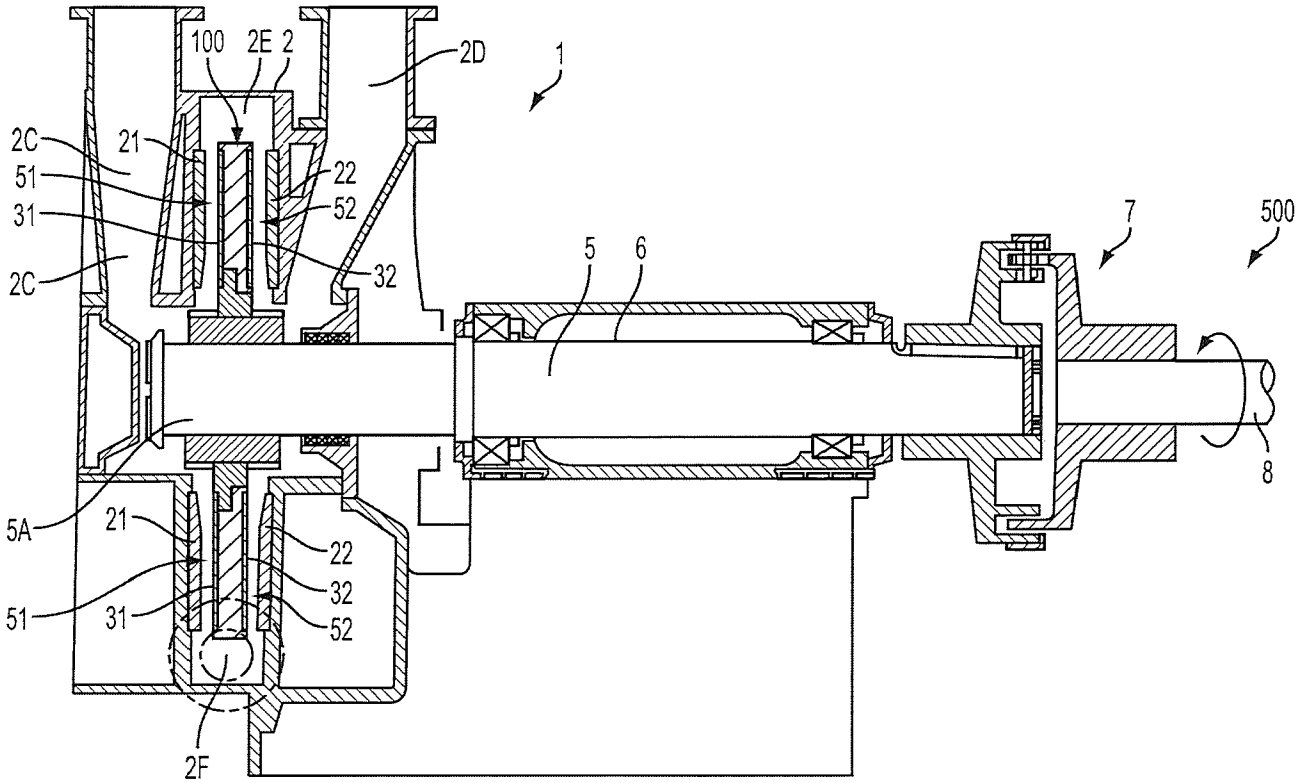
FIG. 1 is a schematic sectional view of a refining apparatus, according to one embodiment of the present invention.

FIG. 1 illustrates a disc refining apparatus 1 for refining a material such as, for example, a tobacco material used in tobacco sheet-making. The disc refining apparatus 1 can be of the type produced, for example, under the 4000 Series, previously manufactured and distributed by Beloit Corporation. Types of equipment suitable for the processing of tobacco material, such as, for example, tobacco leaf stem material, also are set forth, for instance, in U.S. Pat. No. 3,765,613 to Steiniger; U.S. Pat. No. 4,059,237 to Mannstrom; U.S. Pat. No. 5,167,373 to Bohn et al.; U.S. Pat. No. 5,707,016 to Witsken; and U.S. Pat. No. 5,762,275 to Aikawa; which are incorporated herein by reference.

According to one embodiment, the disc refining apparatus 1 includes a disc assembly 100 disposed inside a refining chamber 2. A first refining arrangement 31 may be disposed on one surface of the disc assembly 100. A second refining arrangement 32 may be disposed on the other surface of the disc assembly 100. A first stationary refining arrangement 21 may be provided within the refining chamber 2 to face the first refining arrangement 31, and a second stationary refining arrangement 22 may be provided within the refining chamber 2 to face the second refining arrangement 32. In some instances, the first and second stationary refining arrangements 21, 22 may be formed of a plurality of stationary blade elements in a fan shape. Further, the first and second stationary refining arrangements 21, 22 may be disposed on disc-shaped structures or otherwise formed in the shape of discs to substantially correspond with the shape of the disc assembly 100.

The first refining arrangement 31 may be, for example, formed of a plurality of rotating blade elements in a fan shape and attached to, fixed to, or otherwise engaged with the one surface of the disc assembly 100 by fasteners, such as, for example, bolts or the like (not shown). Similarly, the second refining arrangement 32 may be, for example, formed of a plurality of rotating blade elements in a fan shape and attached, fixed, or otherwise engaged to the other surface of the disc assembly 100 by fasteners, such as, for example, bolts or the like.

The disc assembly 100 is rotatably driven by a drive arrangement 500, for example, having a drive shaft 5 and a drive motor (not shown). The drive shaft 5 may be connected to the motor via a coupling 7, wherein the coupling is connected to a rotating shaft 8 of the motor. The disc assembly 100 is rotatably coupled to a proximal end 5A of the drive shaft 5.

The refining chamber 2 is arranged such that the disc assembly 100 is disposed therein. A first refining zone 51 in which the tobacco material is refined is formed between the first refining arrangement 31 and the first stationary refining arrangement 21. A second refining zone 52 in which the tobacco material is refined is formed between the second refining arrangement 32 and the second stationary refining arrangement 22. A first supply passage 2C may be provided for supplying the tobacco material from the outside of the refining chamber 2 into the first refining zone 51, and a second supply passage 2D may be provided for supplying the tobacco material from the outside of the refining chamber 2 into the second refining zone 52. A communicating chamber 2E may be provided to gather therein the tobacco material refined in both the first refining zone 51 and the second refining zone 52. A discharge port 2F may be provided for discharging the refined tobacco material in the communicating chamber 2E to the outside of the refining chamber 2.

Accordingly, in use, the tobacco material or a solution/pulp suspension thereof flows through the first supply passage 2C into the first refining zone 2A, and also flows through the second supply passage 2D into the second refining zone 2B, and the tobacco material is refined, respectively, between the first refining arrangement 31 and the first stationary refining arrangement 21, and between the second refining arrangement 32 and the second stationary refining arrangement 22.

Figure 2:
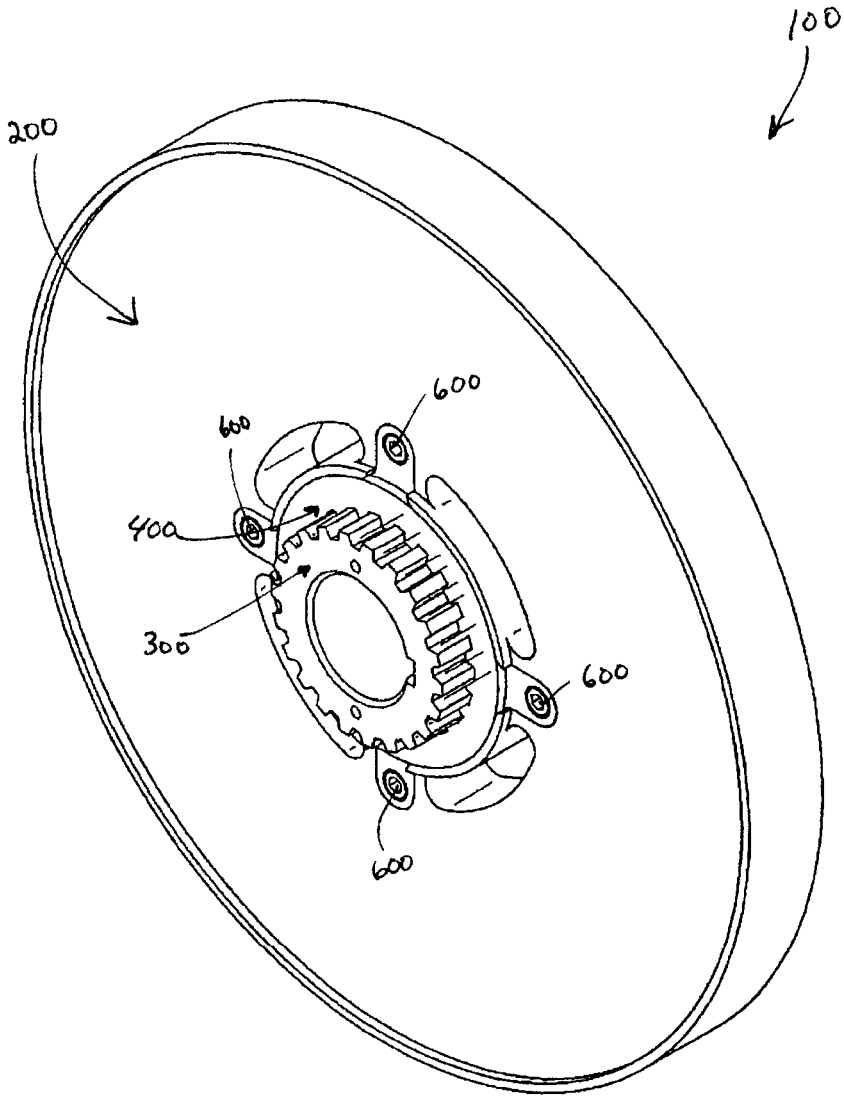
FIG. 2 is a schematic perspective view of a disc assembly for a refining apparatus, according to one embodiment of the present invention.
Figure 3:
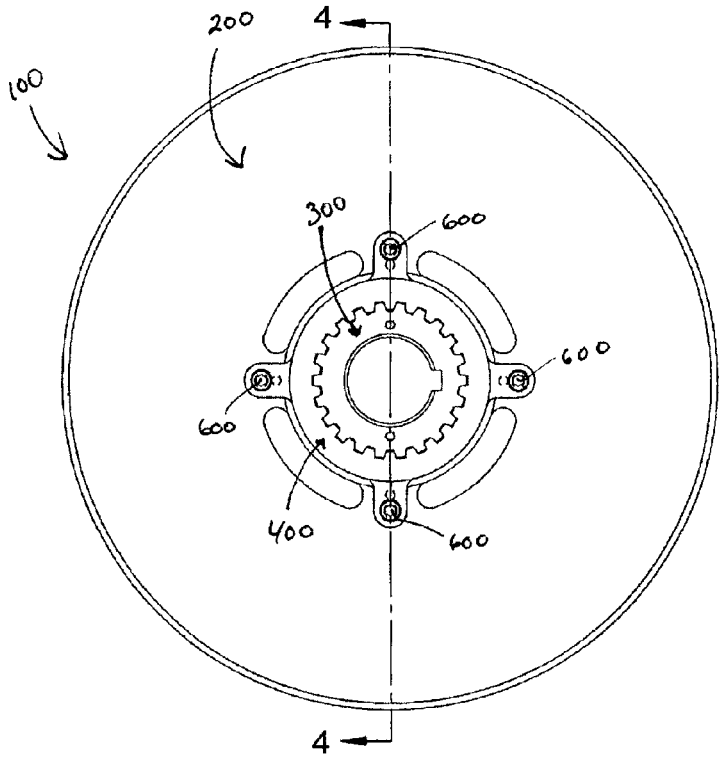
FIG. 3 is a schematic front view of the disc assembly of FIG. 2.
Figure 4:
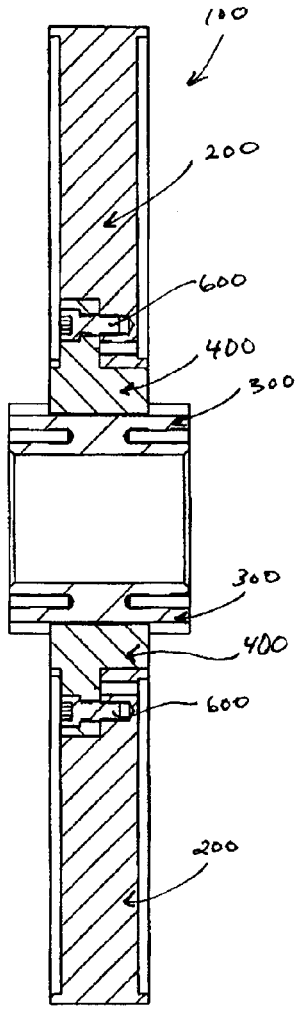
FIG. 4 is a schematic sectional view taken along line 4-4 in FIG. 3.

As shown in FIGS. 2-4, the double disc assembly 100 may include a disc body 200, a first gear member 300, and a second gear member 400. The first gear member 300 is engaged with the drive arrangement 500, and the second gear member 400 is engaged with the disc body 200. The first and second gear members 300, 400 are arranged to engage each other such that interaction therebetween rotatingly drives the disc body 200. The first gear member 300 interacts with the second gear member 400 (i.e., via respective splines) such that rotation of the drive shaft 5 causes the first gear member 300 to rotate, thereby also rotating the second gear member 400 and the disc body 200 coupled thereto. The first and second gear members 300, 400 may be reversible with respect to the other components comprising the disc assembly 100. In this regard, the first and second gear members 300, 400 can function in either orientation (e.g., normal or reversed) so as to extend the useful life thereof. That is, in the normal orientation, the first and second gear members 300, 400 may experience wear from interaction therebetween during the transfer of rotational forces imparted thereto, as well as friction from the interaction therebetween (and/or in some instances, interaction with the material being refined). As such, the worn portions of the first and second gear members 300, 400 can be rearranged (i.e., reversed) to extend the life thereof.

Figure 5:
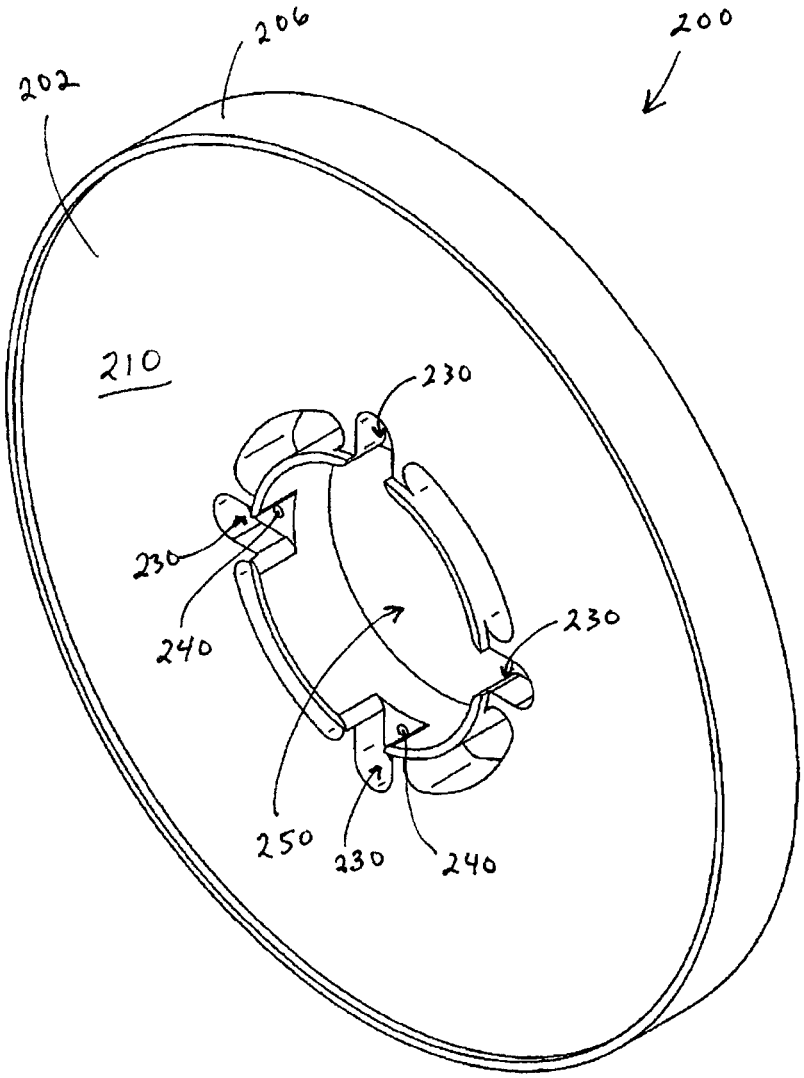
FIG. 5 is a schematic perspective view of a disc body for a disc assembly, according to one embodiment of the present invention.
Figure 6:
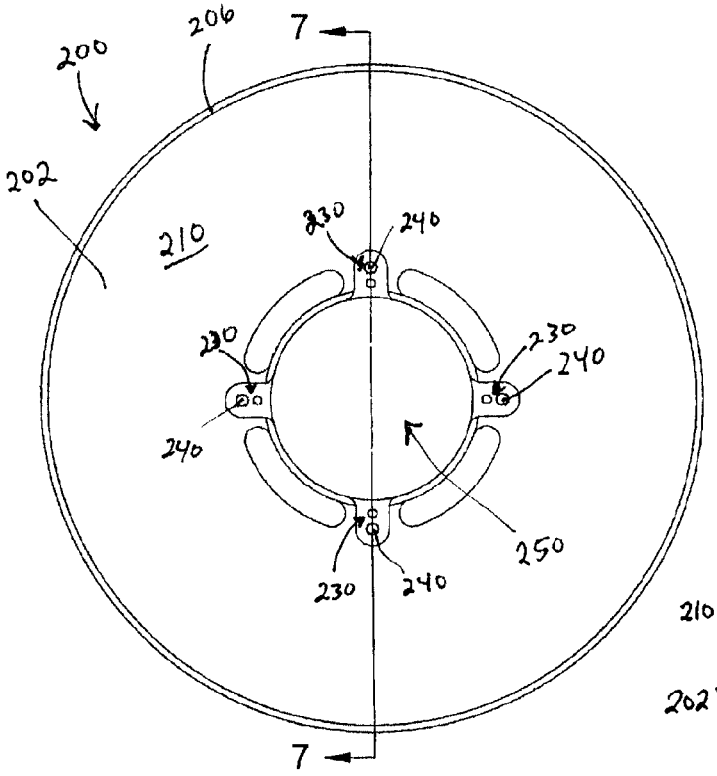
FIG. 6 is a schematic front view of the disc body of FIG. 5.
Figure 7:
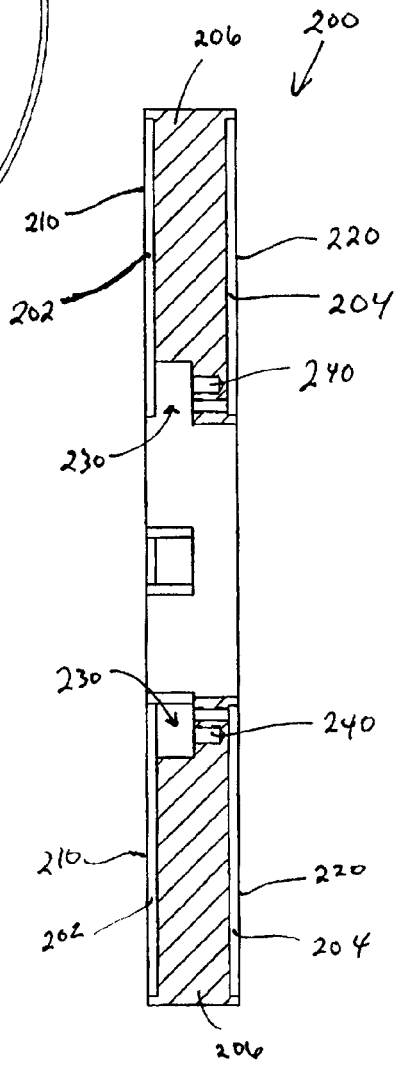
FIG. 7 is a schematic sectional view taken along line 7-7 in FIG. 6.

As shown in FIGS. 5-7, the disc body 200 includes first and second lateral surfaces 210, 220 facing away from each other. The first and second lateral surfaces 210, 220 may have the first and second refining arrangements 31, 32 respectively disposed thereon, or otherwise integrally formed therewith. As such, the first and second refining arrangements 31, 32 may oppose the first and second stationary refining arrangements 21, 22, respectively, in such a manner that facilitates refinement of the tobacco material received in the refining chamber 2. According to some embodiments, the disc body 200 may be formed of multiple components. For example, in one embodiment, the disc body 200 may comprise a pair of disc members 202, 204 attached to, connected to, or otherwise engaged with a central body 206. In other instances, the disc body 200 may be formed of a single workpiece such that the disc members 202, 204 and the central body 206 are integrally formed. In such instances, the first and second refining arrangements 31, 32 may be disposed on the lateral surfaces 210, 220 of the single workpiece. In any instance, the disc body 200 defines a central aperture 250 configured to receive the second gear member 400. In some embodiments, the disc body 200 may define one or more cavity portions 230 for receiving complementary fastening portions 420 (FIGS. 8-10) of the second gear member 400. Within the cavity portions 230 may be fastener apertures 240 for receiving fasteners for fastening the second gear member 400 to the disc body 200.

Figure 8:
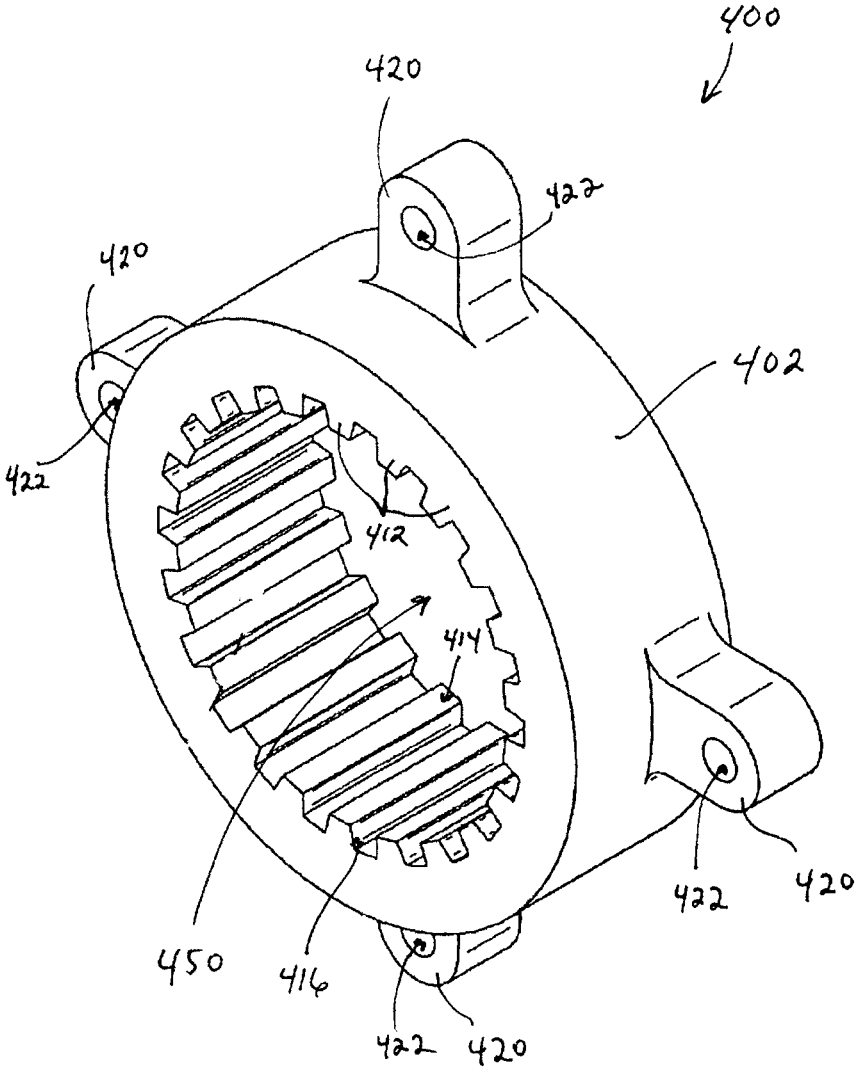
FIG. 8 is a schematic perspective view of a gear member of a disc assembly for a refining apparatus, according to one embodiment of the present invention.
Figure 9:
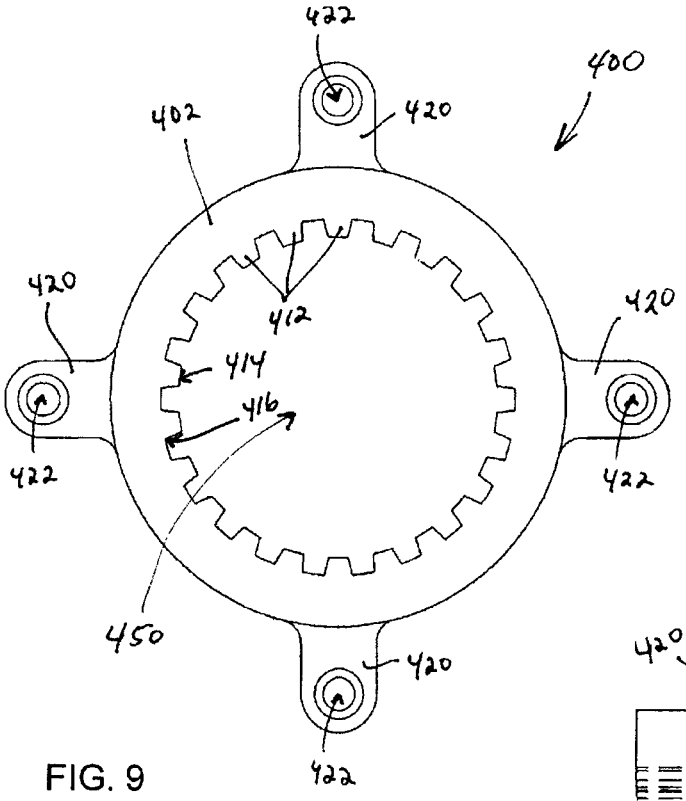
FIG. 9 is a schematic front view of the gear member of FIG. 8.
Figure 10:
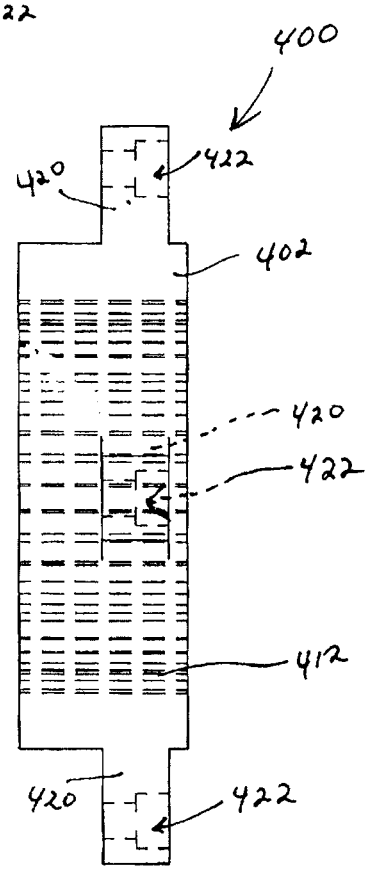
FIG. 10 is a schematic side view of the gear member of FIG. 8.

As shown in FIGS. 8-10, the second gear member 400 includes an annular body 402 defining a central orifice 450 configured to receive the first gear member 300. The interior portion of the annular body 402 includes a plurality of interior splines 412 (i.e., gear teeth), which, in some instances, may have an involute profile. That is, the interior splines 412 may have a profile where a tip portion 414 is narrower than a base portion 416 thereof so as to provide optimum torque-transmitting capacity and optimum contact and pressure distribution during engagement with the corresponding portion of the first gear member 300. The second gear member 400 may include a plurality of fastening portions 420 extending outwardly of the annular body 402 and configured to be received by the cavity portions 230 of the disc body 200. Each fastening portion 420 may define an aperture 422 for receiving a fastener therethrough for engagement with the fastener aperture 240 of the disc body 200. That is, each fastening portion 420 may include the aperture 422 for receiving a corresponding fastener 600 (FIGS. 2-4) for fastening the second gear member 400 to the disc body 200. As such, the second gear member 400 can be coupled to the disc body 200.

The second gear member 400 may be configured to resist wear due to or otherwise caused by interaction with the first gear member 300 (e.g., rotational forces, torque, friction, etc.) and/or the material being refined. That is, the interior splines 412 of the second gear member 400 interact with the first gear member 300 and the resulting friction and other forces can cause degradation or wearing thereof. The second gear member 400 may be comprised of various materials for resisting or otherwise reducing wear about the interior splines 412, such as, for example, a hardened steel (e.g., 17-4PH stainless steel). In some instances, the second gear member 400 may be comprised of 17-4PH stainless steel heat treated to condition H900.

Figure 11:
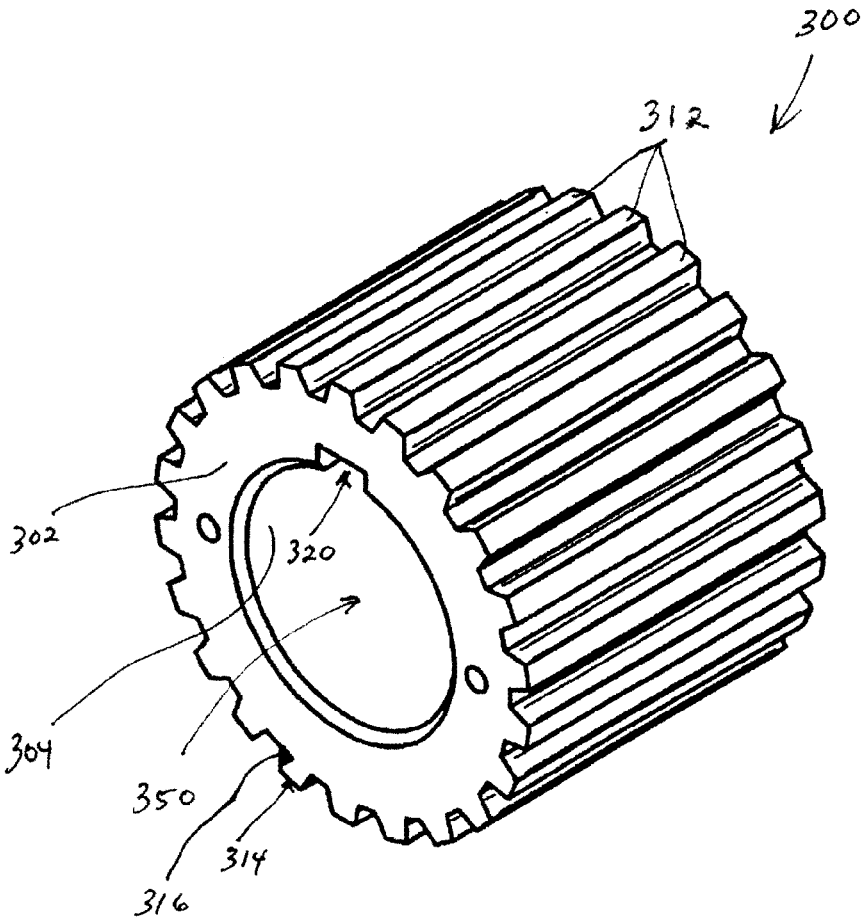
FIG. 11 is a schematic perspective view of another gear member of a disc assembly for a refining apparatus, according to one embodiment of the present invention.
Figure 12:
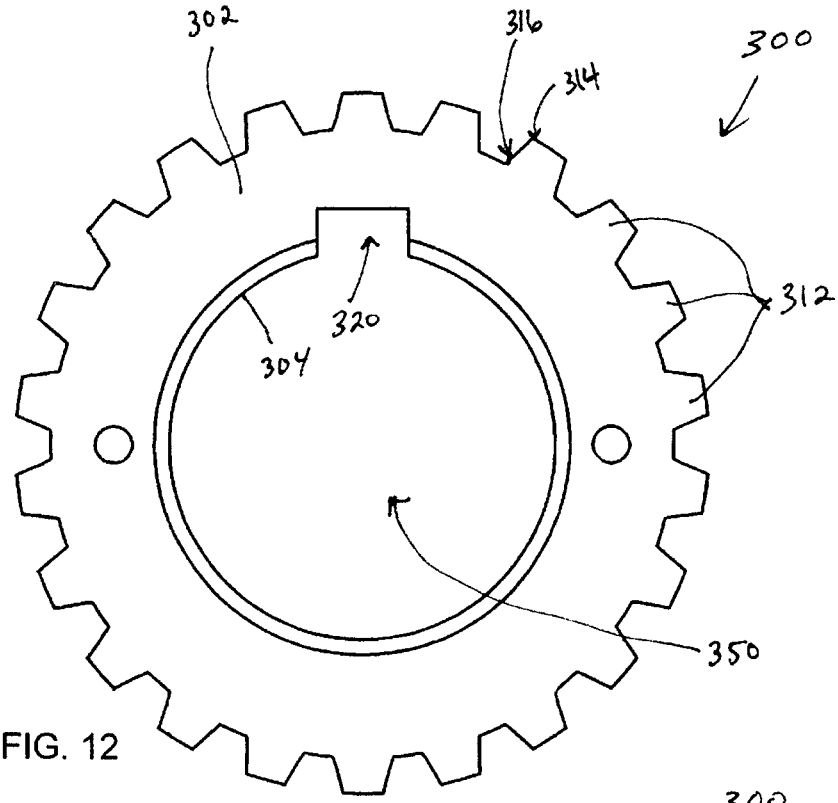
FIG. 12 is a schematic front view of the gear member of FIG. 11.
Figure 13:
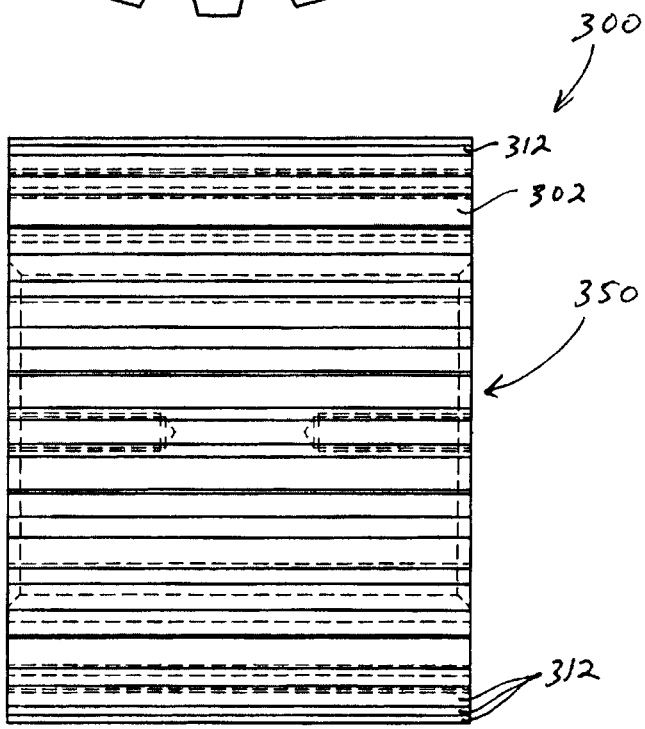
FIG. 13 is a schematic side view of the gear member of FIG. 11.

As shown in FIGS. 11-13, the first gear member 300 includes an annular body 302 defining a central cylindrical channel 350 configured to receive the drive shaft 5. The exterior portion of the annular body 302 includes exterior splines 312 (i.e., gear teeth) configured to mesh with the interior splines 412 of the second gear member 400. The exterior splines 312, which, in some instances, may have an involute profile, disposed about an exterior surface thereof and configured to interact with the interior splines 412 of the second gear member 400. That is, the exterior splines 312 may have a profile where a tip portion 314 is narrower than a base portion 316 thereof so as to provide optimum torque-transmitting capacity and optimum contact and pressure distribution during engagement with the interior spline 412 of the second gear member 400. The first gear member 300 may also define a channel 320 (i.e., keyway) about the interior portion 304 thereof for receiving a correspondingly shaped projection portion (i.e., key) disposed about the exterior surface 6 (FIG. 1) of the shaft 5 and extending longitudinally at least partially along the shaft 5. In this regard, the projection portion is received within the channel 320 in a manner that rotatably couples the first gear member 300 to the drive shaft 5. In some embodiments, the drive shaft 5 may include a plurality of the projections portions or ridges which mesh with a series of corresponding channels 320 defined by the first gear member 300, thereby maintaining the correspondence with the first gear member 300 so as to transfer torque. For example, in one embodiment, the first gear member 300 may be mounted on the drive shaft 5 having a male spline that matches a female spline on the first gear member 300.

The first gear member 300 may be configured to resist wear due to or otherwise caused by interaction with the second gear member 400 (e.g., rotational forces, torque, friction, etc.) and/or the material being refined. That is, the exterior splines 312 of the first gear member 300 interact with the second gear member 400 (i.e., interior splines 412) and the resulting friction and other forces can cause degradation or wearing thereof. The first gear member 300 may be comprised of various materials for resisting or otherwise reducing wear about the exterior splines 312, such as, for example, a hardened steel (e.g., 17-4PH stainless steel). In some instances, the first gear member 300 may be comprised of 17-4PH stainless steel heat treated to condition H900. In some instances, the first and second gear member 300, 400 may be formed of the same material, while in other instances the first and second gear member 300, 400 may be formed of different materials. Furthermore, the material(s) forming the disc body 200 may differ from those forming the first and/or second gear members 300, 400.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for refining a material, the apparatus comprising:

a drive arrangement;

first and second stationary refining arrangements; and a disc assembly engaged with the drive arrangement and configured to be rotatably driven thereby, the disc assembly comprising:

a disc body having first and second lateral surfaces facing away from each other, each lateral surface having a refining arrangement disposed thereon for interacting with a material to be refined, the first and second stationary refining arrangements being positioned such that one of the first and second lateral surfaces opposes one of the first and second stationary refining arrangements to form a first refining zone and the other of the first and second lateral surfaces opposes the other of the first and second stationary refining arrangements to form a second refining zone; and first and second gear members, the first gear member being engaged with the drive arrangement, the second gear member being engaged with the disc body, and the first and second gear members being arranged to engage each other such that interaction therebetween rotatingly drives the disc body via the drive arrangement, the first and second gear members being further configured to resist wear associated with interaction therebetween, and one of the first gear member and the second gear member being configured to be removed from, reversed with respect to, and re-engaged with the drive arrangement and the disc body, respectively, so as to be reversibly engaged therewith and for extending an operational life of the one of the first gear member and the second gear member.

2. An apparatus according to claim 1 wherein each of the first and second gear members comprises an annular body, the second gear member annular body having an interior spline configured to interact with an exterior spline of the first gear member annular body.

3. An apparatus according to claim 2 wherein the first gear member annular body comprises a plurality of exterior splines and the second gear member annular body comprises a plurality of interior splines configured to interact with the exterior splines so as to rotatably couple the first gear member with the second gear member.

4. An apparatus according to claim 3 wherein the interior and exterior splines have an involute profile.

5. An apparatus according to claim 1 wherein the first gear member comprises an annular body defining a central orifice for receiving a drive shaft of the drive arrangement, the first gear member further defining a keyway configured to receive a corresponding key extending at least partially along a longitudinal axis of the drive shaft.

6. An apparatus according to claim 1 wherein the second gear member is fixedly engaged with the disc body by a plurality of fasteners.

7. An apparatus according to claim 1 wherein at least one of the first and second gear members comprises a hardened steel.

8. An apparatus according to claim 1 wherein at least one of the first and second gear members comprises a heat treated stainless steel.

9. An apparatus according to claim 1 wherein the disc body comprises integrally formed first and second disc members.

10. An apparatus according to claim 1 wherein the disc body comprises a plurality of cavity portions configured to receive a respective fastening portion extending from the second gear member.

* * * * *